United States Patent [19]

Ushiyama et al.

[11] Patent Number: 5,017,932

[45] Date of Patent: May 21, 1991

[54] MINIATURE ANTENNA

[75] Inventors: Katsumi Ushiyama; Sadafumi Sakamoto, both of Tokyo; Kiyohiko Itoh, Sapporo, all of Japan

[73] Assignees: Kokusai Electric Co., Ltd., Tokyo; Kiyohiko Itoh, Sapporo, both of Japan

[21] Appl. No.: 443,366

[22] Filed: Oct. 27, 1989

[30] Foreign Application Priority Data

Nov. 4, 1988 [JP] Japan ..... 63-277328

[51] Int. Cl.[5] ..... H01Q 1/24

[52] U.S. Cl. ..... 343/702; 343/866; 343/855

[58] Field of Search ..... 343/702, 866, 855

[56] References Cited

U.S. PATENT DOCUMENTS

| | | | |
|---|---|---|---|
| 4,004,228 | 1/1977 | Mullett | 343/702 |
| 4,123,756 | 10/1978 | Nagata et al. | 343/702 |
| 4,625,212 | 11/1986 | Oda et al. | 343/702 |
| 4,862,181 | 8/1989 | Ponce De Leon et al. | 343/702 |

FOREIGN PATENT DOCUMENTS

| | | | |
|---|---|---|---|
| 60-07204 | 1/1985 | Japan | 343/702 |

*Primary Examiner*—Rolf Hille
*Assistant Examiner*—Hoanganh Le
*Attorney, Agent, or Firm*—Emmanuel J. Lobato; Robert E. Burns

[57] ABSTRACT

A miniature antenna, in which a pair of square conductor plates disposed in parallel with a spacing sufficiently smaller than the wavelength used are fixed to each other to an insulating frame to form an antenna structure which is used also as a case. Feeding terminals are provided at a desired position on one side of each of the conductor plates. High-frequency-wise short-circuit elements are provided at a plurality of positions on other sides of the conductor plates. A gravity-direction sensor, which produces an output in accordance with the direction of gravity, is provided in the case. The plurality of short-circuit elements are selectively short-circuited by the output of the gravity-direction sensor so that the plane of polarization of the antenna is brought into agreement with the direction of gravity.

3 Claims, 5 Drawing Sheets

MINIATURE ANTENNA

BACKGROUND OF THE INVENTION

The present invention relates to a miniature antenna for use with a portable miniature radio transceiver or the like.

Conventionally, loop antennas of monopole antennas are widely employed for portable miniature radio transceivers and they are inevitably adapted for operation primarily in the plane of vertical polarization. Vertically polarized electric waves transmitted from the transmitting station toward the receiver are partly rendered into a horizontally polarized component under the influence of surrounding conditions, and in general, the vertically polarized component is received with an intensity several times higher than the horizontally polarized component. The distance range of communication significantly differs depending on whether the plane of polarization of the receiving antenna is held to be vertical or horizontal with respect to such incoming electric waves. For example, in case of a pager receiver using a loop antenna, its receiving sensitivity markedly differs depending on whether the receiver is placed longitudinally or sideways.

Conventional portable miniature radio transceivers have not taken any counter measures to this disadvantage.

For instance, the prior art pager receiver is equipped with an antenna in such a manner that the receiving sensitivity is maximum when it is carried vertically in a breast pocket of user's shirt, but in practice, it is often carried in a pocket of a jacket, a bag, handbag, or the like. In such a case, the pager receiver is usually laid at its side, that is, it is kept in the direction in which the directivity is the lowest, resulting in the coverage of communication being seriously impaired.

SUMMARY OF THE INVENTION

An object of the present invention is to provide a miniature antenna for portable miniature radio transceivers which is designed so that its directional patterns are always optimized through utilization of terrestrial gravitation to keep optimum receiving sensitivity, thereby improving the distance range of communication.

To solve the above problem and attain the above object, the miniature antenna of the present invention is characterized in that it is formed by a pair of parallel-opposed square conductor plates assembled together by an insulating frame interposed and defining therebetween a space sufficiently smaller than the wavelength used; feeding points are each provided at a desired position on one side of each conductor plate and short-circuit elements, each of which can be short-circuited in high-frequency-wise by a conductor or capacitor, are provided at a plurality of desired positions on other sides of the conductor plates; and one of the short-circuit elements is actuated so that a plane of polarization can always be obtained in a fixed direction with respect to terrestrial gravitation through utilization of gravity, thereby forming a flat plate-shaped loop antenna which is used also as a receiver case. That is to say, a gravity-direction sensor is provided in a portable miniature radio transceiver having such a miniature antenna and the output of the gravity-direction sensor corresponding to the direction in which the radio transceiver is placed is used to short-circuit one of the short-circuit elements so that the plane of polarization of the antenna is aligned with the direction of gravity, i.e. the plane of vertical polarization of electric waves being transmitted.

With such a structure, the direction of the plane of polarization of the antenna is switched to an optimum direction in accordance with the state of the transceiver being carried so that the coverage of communication can be optimized. In other words, it is possible to overcome a defect of the prior art that the direction of the antenna changes with the state of the transceiver being carried and the receiving sensitivity decreases accordingly, resulting in the deterioration of the coverage of communication.

BRIEF DESCRIPTION OF THE DRAWINGS

The present invention will be described in detail below in comparison with prior art with reference to accompanying drawings, in which.

DETAILED DESCRIPTION

Figure 1A:
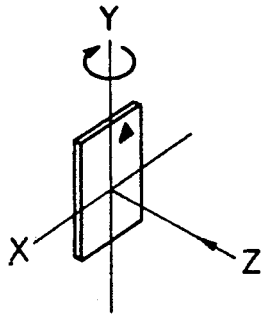
PRIOR ART Fig. 1A
FIGS. 1A, 1B, 1C and 1D are diagrams explanatory of directional patterns of a conventional pager receiver, obtained by measuring its receiving sensitivity when the receiver was turned about the X, Y and Z axes with respect to the direction of arrival of incoming electric waves.
Figure 1B:
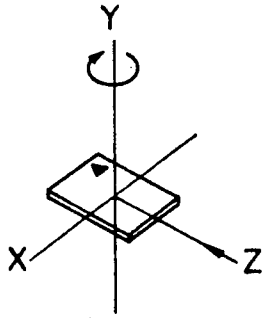
PRIOR ART Fig. 1B
Figure 1C:
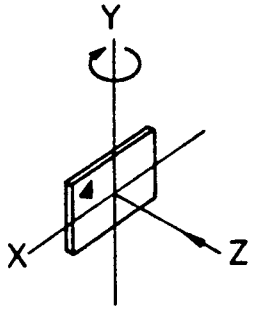
PRIOR ART Fig. 1C
Figure 1D:
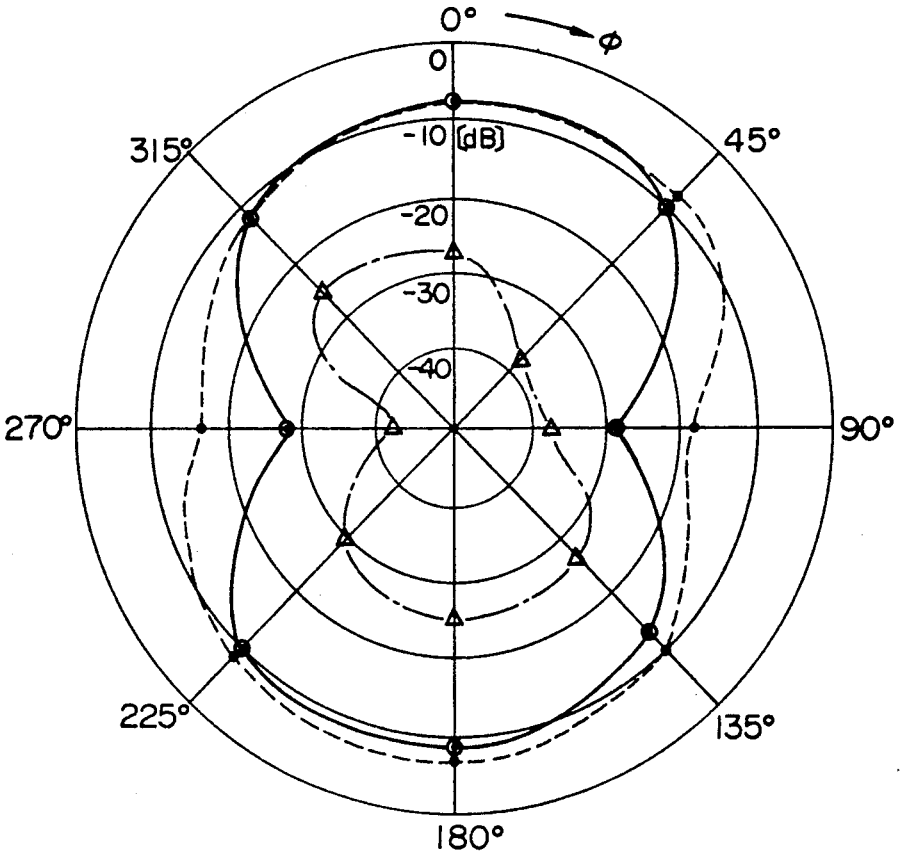
PRIOR ART Fig. 1D

With reference to FIGS. 1A, 1B, 1C and 1D, directional patterns of the receiving sensitivity of a card typed pager receiver will first be described. The values indicated were obtained by measuring the receiving sensitivity to vertically polarized electric waves incoming from Z-axis direction at each 45° rotation angle of the receiver about the Y axis. In FIG. 1 the receiving sensitivity, indicated in decibel, decreases to inner ones of the concentric circles. The directional patterns in the cases of the pager receiver being placed (1A) vertically (longitudinally), (1B) horizontally, and (1C) sideways are indicated by the solid line, the broken line, and the one-dot chain line respectively. It is evident from FIGS. 1A, 1B and 1C that the sensitivity is significantly low when the pager receiver is held sideways as shown in FIG. 1C.

With reference to the accompanying drawings, an embodiment of the present invention will hereinafter be described in detail.

Figure 2A:
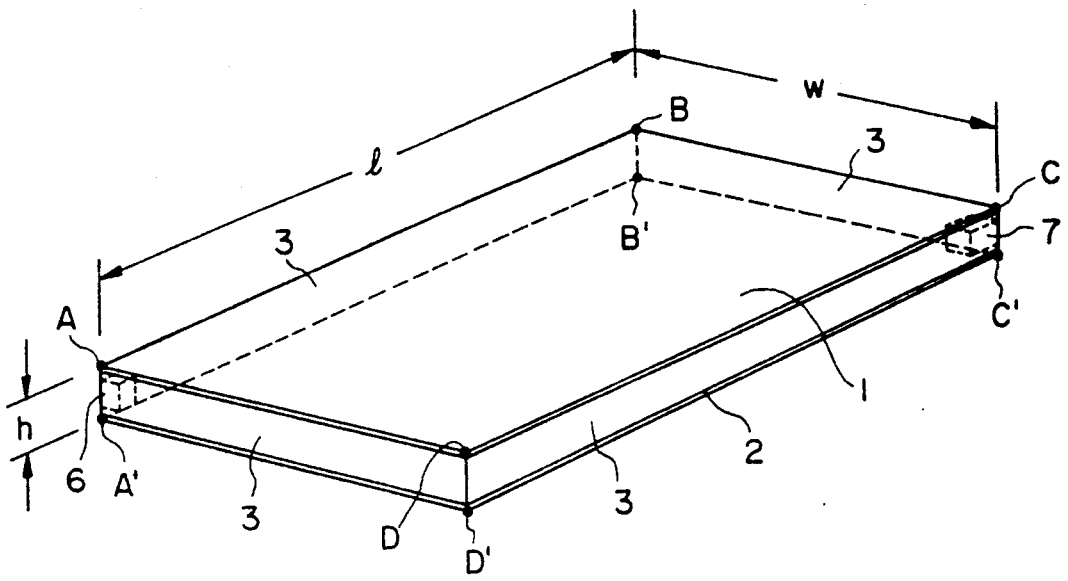
FIG. 2A is a perspective view showing an embodiment of the miniature antenna of the present invention.
Figure 2B:
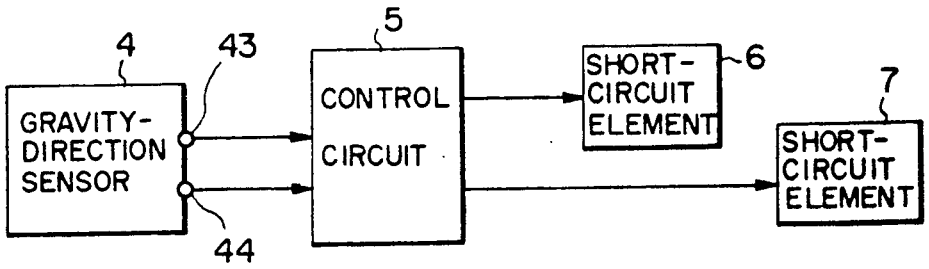
FIG. 2B is its system diagrams.

FIGS. 2A and 2B are a perspective view illustrating the construction of an embodiment of the miniature antenna according to the present invention and a block diagram showing a gravity-direction sensing short-circuit element control system. In FIG. 2A, reference numerals 1 and 2 indicate a pair of square conductor plates disposed in parallel with a spacing h sufficiently smaller than the wavelength used, and 3 designates an insulating frame interposed between the pair of conductor plates 1 and 2. The conductor plates and the insulating frame constitute a flat loop antenna element and, at the same time, serves as a case of the transceiver. The case is a flat rectangular parallelepiped (a card) with a length l of 80 mm, a width W of 50 mm and a height (or thickness) h of 3.6 mm, and the case has incorporated therein functional circuits of the transceiver, together with a gravity-direction sensor 4 and a control circuit 5 shown in the system diagram of FIG. 2B.

Feeding points are provided at desired positions on one side of the pair of conductor plates 1 and 2, i.e. at a pair of opposed corners D and D' of the plates in this embodiment, and short-circuit elements 6 and 7 are provided at two or more desired opposite positions on the other sides of the plates, i.e. at the other opposite corners A, A', C and C' in this embodiment. Any one of the short-circuit elements 6 and 7 is actuated by the output of the control circuit 5 to short-circuit the conductor plates 1 and 2, causing them to serve as the flat loop antenna.

Figure 5A:
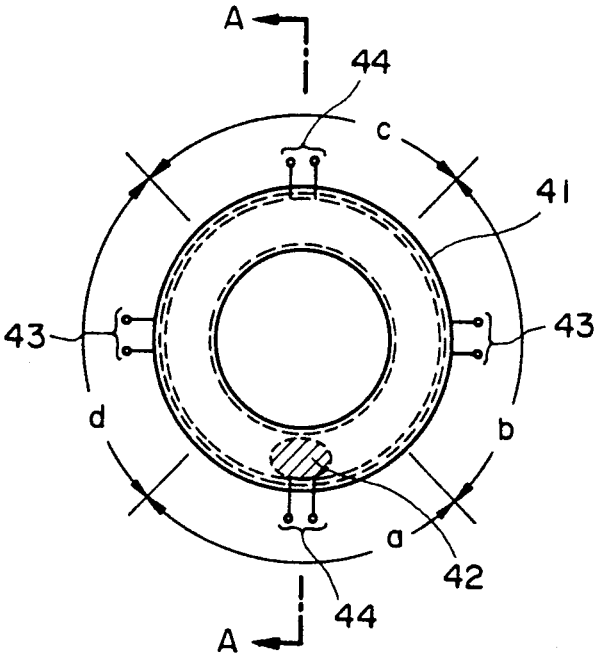
FIGS. 5A and 5B are diagrams illustrating an embodiment of a gravity-direction sensor.
Figure 5B:
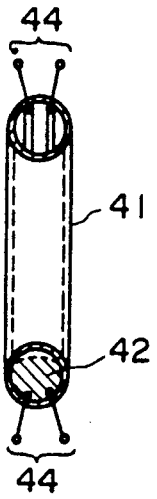

FIGS. 5A and 5B schematically illustrate the construction of an embodiment of the gravity-direction sensor 4, FIG. 5A being its front view and FIG. 5B a sectional view taken on the line A—A in FIG. 5A. . In FIGS. 5A and 5B, reference numeral 41 indicates a hollow circular ring made of an insulator, and 42 a ball of mercury which is freely movable in the hollow of the ring by gravity. The interior of the circular ring 41 is divided into sections a, b, c and d, in which there are provided parallel rail-shaped contacts 3 and 44 extending along the inner wall of the ring. Even if the direction of the circular ring 41 is changed, the ball of mercury 42 always stays at the lowest position by gravity and short-circuits the contacts in that one of the sections a, b, c and d in which it happens to lie. The output contacts 44 are short-circuited when the receiver, and consequently, the antenna is held almost vertically, that is, when the ball of mercury 42 lies in the section a or c. The output contacts 43 are short-circuited when the receiver or antenna is held sideways, that is, when the ball of mercury 2 is positioned by gravity in the section b or d. In consequence, the gravity-direction sensor 4 produces an output accordingly.

Reference numeral 5 identifies a control circuit, which outputs a control signal for actuating the short-circuit element 6 or 7 by the output signal from the gravity-direction sensor 4.

Figure 3A:
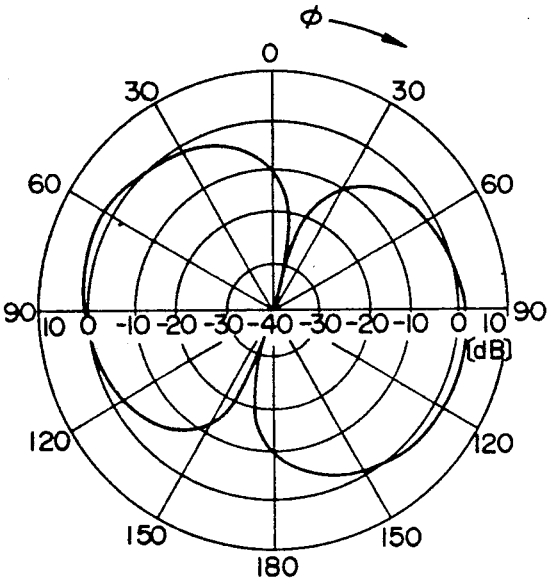
FIGS. 3A, 3B and 3C are diagrams of directional patterns of the embodiment of the miniature antenna according to the present invention.
Figure 3B:
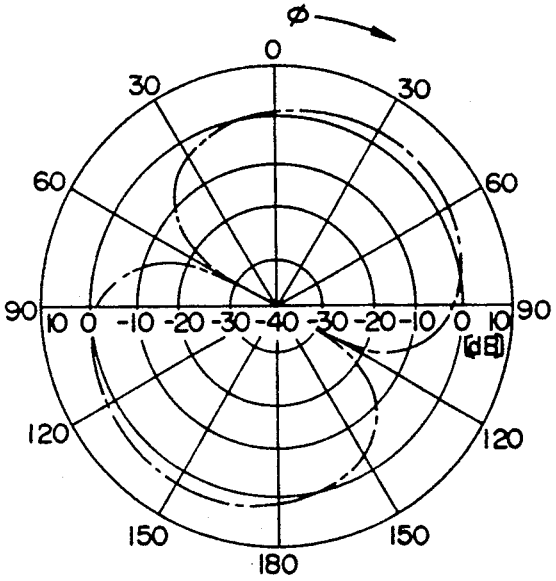
Figure 3C:
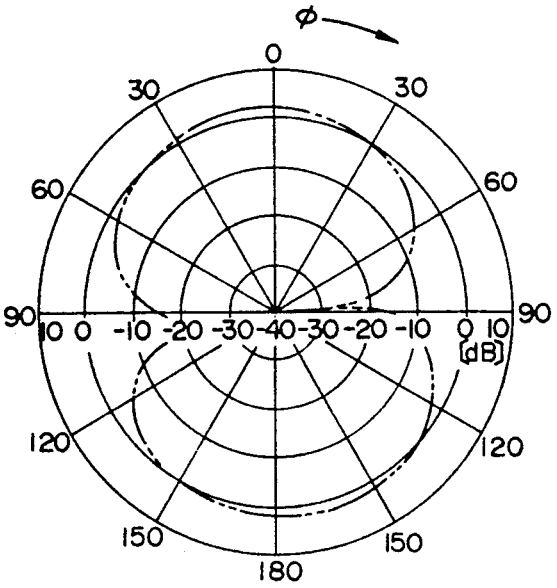
Figure 3D:
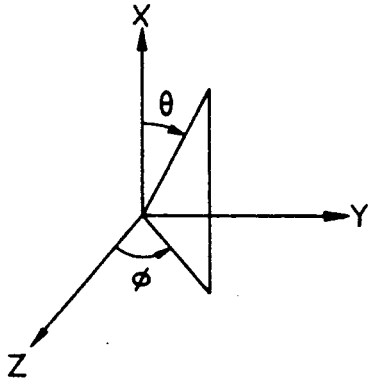
FIG. 3D is a diagram explanatory of their angular relationship.

FIGS. 3A, 3B and 3C show gain characteristics of the antenna of this embodiment in the plane of polarization in the Z-axis direction in the cases where feed is effected from the pair of opposed corners D and D' and the corners A and A, B and B', and C and C' are short-circuited, respectively. A notation $\theta$ in FIG. 3D indicates the inclination of the plane of polarization from the X axis. That is, polarized waves with $\theta=0°$ and $\theta=90°$ are parallel to the X axis and the Y axis, respectively. In any case, the direction of polarized waves of high radiation intensity is substantially in agreement with the direction in which the short-circuit point is viewed from the feeding point.

As is evident from FIGS. 3A to 3D, the polarized wave directivity characteristic of the receiving field can be changed by shifting the short-circuit points on the pair of parallel-opposed conductor plates 1 and 2 to desired positions on their marginal edges. This means that the directivity of the antenna can always be held to be optimum with respect to the direction in which electric waves are received or radiated, through automatic control of the short-circuiting positions.

Figure 4:
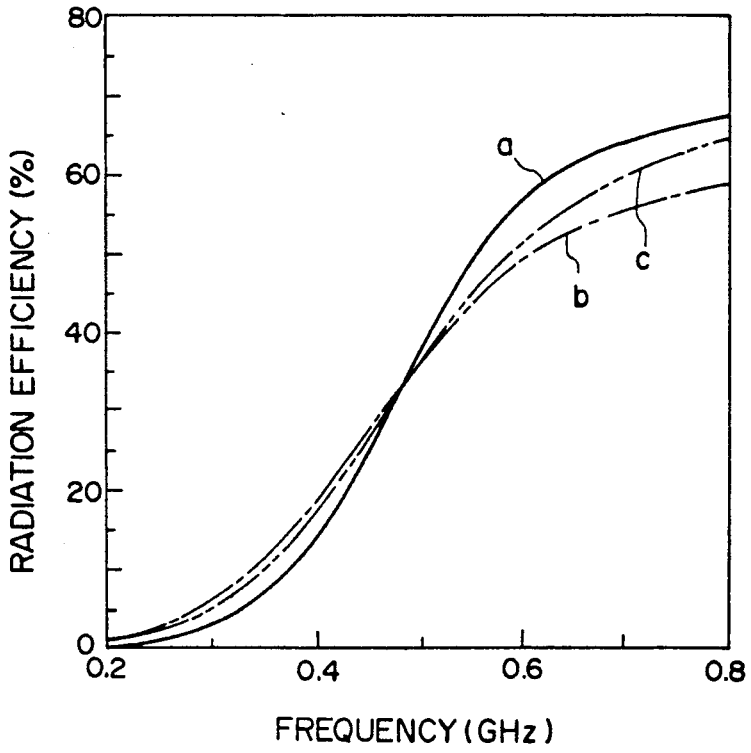
FIG. 4 is a diagram explanatory of variations of the antenna radiation efficiency in the embodiment.

The curves a through c in FIG. 4 show variations of the radiation efficiency relative to frequency when the opposed corners A and A', B and B', C and C' were short-circuited, respectively.

It was ascertained that the resonance frequency would undergo substantially no variation, no matter which pair of opposed points A and A', B and B', C and C' are short-circuited, and that substantially the same radiation efficiency at the resonance point could also be obtained regardless of the short-circuiting point.

While in the above the short-circuit points between the pair of conductor plates 1 and 2 disposed in parallel are described to be automatically switched between the two points A and A', C and C' so as to facilitate a better understanding of the invention, it was confirmed that substantially the same effect as mentioned above could also be produced when the short-circuit elements are provided at desired points such as B, B' in combination with the gravity-direction sensor 4.

Moreover, although in the above the gravity-direction sensor 4 has been described to be the circular ring 41 which employs a metallic ball (the ball of mercury 42), it is also possible, for further miniaturization, to adopt an arrangement in which a floating phenomenon by liquids such as water and oil so that the short-circuit elements are selectively actuated in response to a change in their capacitance or inductance.

The short-circuit elements 6 and 7 need only to be short-circuited high-frequency-wise and they can be implemented by pin diodes or varicap diodes. It is also possible to from them as a part of the mechanical structure of the gravity-direction sensor so that the capacitances of the short-circuit elements are directly varied.

The above embodiment has been described in connection with the case where the plane of polarization of the receiving antenna of a receiver is adjusted to the plane of vertically polarized waves sent from the transmitting side, but it is a matter of course that the present invention can be applied to a transmitter so that it transmits electric waves in the plane of vertical polarization.

As described above, according to the present invention, the antenna structure can also be used as the transceiver case, and consequently, the radio transceiver can be miniaturized. Further, the directivity of the antenna can always be held optimum with respect to the direction of arrival of incoming electric waves regardless of the direction in which the radio transceiver is placed. Accordingly, the present invention is highly effective for improving the coverage of communication as well as for the implementation of miniature, lightweight and thin (card-like) portable radio transceivers.

What we claim is:

1. A miniature antenna, comprising:

a pair of square conductor plates disposed in parallel with a spacing sufficiently smaller than a wavelength used and fixed to each other to an insulating frame to form an antenna structure which is used also as a case;

feed terminal means provided at a a pair of opposed positions on one of opposed sides of the conductor plates;

short-circuit elements, provided at a plurality of positions on other opposed sides of the conductor plates to short-circuit in high frequency-wise;

a gravity-direction sensor disposed in the case to produce an output in accordance with the direction of gravity with respect to a plane along any of the conductor plates to selectively short circuit said short-circuit elements by the output of the gravity-direction sensor so that a plane of polarization established by a seated state antenna is brought into agreement with the direction of gravity.

2. A miniature antenna according to claim 1, in which the feed terminal means is disposed at one pair of opposed corners of the square conductor plates, and the short-circuit elements being disposed at other pairs of opposed corners of the square conductor plates.

3. A miniature antenna according to claim 1, in which said gravity-direction sensor comprises a hollow circular ring of insulating material, a ball of mercury held in the hollow circular ring, and four pairs of terminals disposed on the hollow circular ring to effectively divide into four arc sections the hollow circular ring to be short circuited by the ball of mercury for each pair.

* * * * *